US008384645B2

(12) United States Patent
Ma et al.

(10) Patent No.: US 8,384,645 B2
(45) Date of Patent: Feb. 26, 2013

(54) METHOD FOR DRIVING LCD PANEL AND LCD USING THE SAME

(75) Inventors: Mei-Sheng Ma, Hsinchu (TW); Chien-Hung Chen, Hsinchu (TW); Chun-Huai Li, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 1144 days.

(21) Appl. No.: 12/129,633

(22) Filed: May 29, 2008

(65) Prior Publication Data

US 2009/0244104 A1 Oct. 1, 2009

(30) Foreign Application Priority Data

Mar. 31, 2008 (TW) ..... 97111770 A

(51) Int. Cl.
*G09G 3/36* (2006.01)

(52) U.S. Cl. ..... 345/99; 345/87; 345/88; 345/94; 345/95; 345/98

(58) Field of Classification Search ..... 345/99
See application file for complete search history.

(56) References Cited

U.S. PATENT DOCUMENTS

| | | | | |
|---|---|---|---|---|
| 4,907,862 | A | 3/1990 | Suntola | |
| 7,724,227 | B2 * | 5/2010 | Yang et al. | 345/95 |
| 7,737,936 | B2 * | 6/2010 | Daly | 345/102 |
| 2007/0085798 | A1 * | 4/2007 | Hashimoto et al. | 345/93 |
| 2007/0188432 | A1 | 8/2007 | Kwon et al. | |
| 2007/0279360 | A1 | 12/2007 | Park et al. | |

FOREIGN PATENT DOCUMENTS

| | | |
|---|---|---|
| TW | 200401250 | 1/2004 |
| TW | 200405068 | 4/2004 |
| TW | 200725525 | 7/2007 |

OTHER PUBLICATIONS

"Office Action of Taiwan counterpart application" issued on Sep. 20, 2012, p. 1-p. 7.

* cited by examiner

*Primary Examiner* — Sumati Lefkowitz
*Assistant Examiner* — Andrew Yeretsky
(74) *Attorney, Agent, or Firm* — Jianq Chyun IP Office

(57) ABSTRACT

A method for driving an LCD panel and an LCD using the same are provided. The method includes following steps. Firstly, a number of scan signals are provided sequentially, and an enabling time of the scan signals excluding the last scan signal is adjusted according to a compensation time, so as to unfix the enabling time of these scan signals. Next, the scan signals having the unfixed enabling time are sequentially provided to an LCD panel, so as to turn on a number of row pixels of the LCD panel one by one. Thereby, the entire brightness of the LCD can be uniformed by applying the method disclosed in the present invention.

11 Claims, 3 Drawing Sheets

METHOD FOR DRIVING LCD PANEL AND LCD USING THE SAME

CROSS-REFERENCE TO RELATED APPLICATION

This application claims the priority benefit of Taiwan application serial no. 97111770, filed on Mar. 31, 2008. The entirety of the above-mentioned patent application is hereby incorporated by reference herein and made a part of this specification.

BACKGROUND OF THE INVENTION

1. Field of the Invention

The present invention relates to a flat display technology, and more particularly to a method for driving a liquid crystal display (LCD) panel and an LCD using the same.

2. Description of Related Art

In recent years, with great advance in the fabricating techniques of opto-electronics and semiconductor devices, flat panel displays (FPDs) have been vigorously developed. Among the FPDs, a liquid crystal display (LCD) has become the mainstream display product due to its advantages of outstanding space utilization efficiency, low power consumption, free radiation, and low electrical field interference. The LCD includes an LCD panel and a backlight module in most cases. Since the LCD panel can not emit light, the backlight module disposed underneath the LCD panel is required to function as a planar light source to provide the LCD panel with light on which images being displayed.

In a conventional LCD, the backlight module acting as the planar light source required by the LCD panel generally provides a white light, and the LCD can then display different colors through a color filter disposed on each pixel region in the LCD panel. In view of the above, red, green, and blue color filters must be disposed on each of the pixel regions, thus increasing manufacturing costs and reducing the transmittance of each pixel after the white light passes through the color filters.

As a result, in the recently-designed LCD, a light emitting diode (LED) backlight source is generally utilized to replace the traditional white backlight source to display the colors of the pixels. In other words, the colors are mixed on an axis of space. Specifically, three sub-pixels of red, green and blue colors mixed together within viewing angles of human beings are replaced by mixing the three sub-pixels on an axis of time. That is to say, the red, green, and blue colors emitted by the LED backlight source are rapidly switched within a range of time of visual perception of human beings.

For instance, if dynamic images are displayed at the frequency of 60 frames per second, a refresh rate of the LCD panel must be increased from 16.67 ms (1/60 second) to 5.56 ms (1/180 second) given that the red, green and blue color images are rapidly switched on the axis of time. Said driving method is referred to as a color sequential method by which the color filters are not required to be disposed on each of the pixel regions within the LCD panel, and thereby increasing the transmittance of each pixel.

Nevertheless, a response speed of liquid crystal molecules of each pixel in the LCD panel is still not sufficient enough at this current stage. Therefore, when the same data signals are provided to each pixel of the LCD panel, the luminance of the last row pixels of the LCD is reduced in comparison with the luminance of the first row pixels of the LCD, which results in uneven brightness. A problem of poor image quality on a color sequential LCD accordingly arises. As such, the issue of the uneven brightness is often encountered in normal color sequential LCDs.

SUMMARY OF THE INVENTION

In light of the foregoing, the present invention is directed to a method for driving an LCD panel and an LCD using the same, wherein the entire brightness of a color sequential LCD is uniformed by sequentially providing a plurality of scan signals to the LCD panel. Here, an enabling time of the scan signals is not constant.

Based on the above, a method for driving an LCD panel is provided herein. In the method, a plurality of scan signals are sequentially provided, and an enabling time of the scan signals excluding the last scan signal is adjusted according to a compensation time, so as to unfix the enabling time of the scan signals. Next, the scan signals having the unfixed enabling time are sequentially provided to the LCD panel, so as to turn on a plurality of row pixels of the LCD panel one by one.

From another perspective, the present invention provides an LCD including an LCD panel and a gate driver. The LCD panel has a plurality of pixels arranged in matrix, and the gate driver is coupled to the LCD panel and is controlled by a timing controller (T-con). The gate driver is used to sequentially output a plurality of scan signals to the LCD panel, so as to turn on a plurality of row pixels of the LCD panel one by one. Here, an enabling time of the scan signals is unfixed.

According to an embodiment of the present invention, the LCD further includes a compensation module coupled to the T-con and used to determine a compensation time. Here, the T-con adjusts the enabling time of the scan signals excluding the last scan signal according to the compensation time, so as to unfix the enabling time of the scan signals.

According to an embodiment of the present invention, the LCD further includes a source driver coupled to the LCD panel and controlled by the T-con. The source driver is used to provide data signals.

According to an embodiment of the present invention, the LCD further includes a backlight module coupled to the LCD panel and controlled by the T-con. The backlight module is used to provide a planar light source required by the LCD panel. Here, the backlight module is an LED backlight module.

In the aforesaid embodiment, the compensation time is determined upon performing following steps. First, a reference scan signal is provided to the last row pixels of the LCD panel, and a data signal is provided to the last row pixels of the LCD panel according to an enabling time of the reference scan signal, so as to obtain a reference transmittance of the last row pixels of the LCD panel. Next, a test scan signal is provided to the first row pixels of the LCD panel, and the data signal is provided to the first row pixels of the LCD panel according to an enabling time of the test scan signal, so as to obtain a test transmittance of the first row pixels of the LCD panel. Here, the enabling time of the test scan signal is less than the enabling time of the reference scan signal.

Thereafter, the test transmittance is compared with the reference transmittance. If the test transmittance is not equal to the reference transmittance, the enabling time of the test scan signal is adjusted, so as to substantially equalize the test transmittance with the reference transmittance. Finally, a subtraction is performed between the enabling time of the reference scan signal and the adjusted enabling time of the test scan signal, and the result of the subtraction is further divided by the number of all scan lines of the LCD panel, so as to obtain the compensation time.

In the aforesaid embodiment, the adjusted enabling time of the $(i+1)^{th}$ scan signal is more than the adjusted enabling time of the $i^{th}$ scan signal, and i is a positive integer.

In the aforesaid embodiment, there can be an unfixed time interval or no time interval between the adjusted enabling time of the $(i+1)^{th}$ scan signal and the adjusted enabling time of the $i^{th}$ scan signal.

In order to uniform the entire display luminance of the color sequential LCD, the method for driving the LCD panel is proposed in the present invention. In the method, the scan signals having the unfixed enabling time are provided to the LCD panel. Besides, based on the transmittance corresponding to a data voltage applied to the last row pixels of the LCD panel, the compensation time is reduced by one at a time until the data voltage is applied to the first row pixels of the LCD panel. Namely, the enabling time of the scan signal provided to the last row pixels of the LCD panel is the longest, while, the enabling time of the scan signal provided to the first row pixels of the LCD panel is the shortest. With use to the adjusted scan signals, the row pixels of the LCD panel are turned on one by one.

Thus, when the same data voltage is applied to each of the row pixels of the LCD panel, the brightness of each of the row pixels of the LCD panel substantially reaches the same level. As such, the LCD (e.g. the color sequential LCD) employing the method for driving the LCD panel as disclosed in the present invention can be characterized by the uniform display brightness.

In order to make the aforementioned and other objects, features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

One of the technical solutions intended to be achieved by the present invention is to resolve a conventional issue of uneven display luminance of a color sequential LCD. Detailed descriptions with respect to the technical features and the intended effects of the present invention are provided hereinafter so as, to serve as a reference for those skilled in the pertinent art of the present invention.

Figure 1:
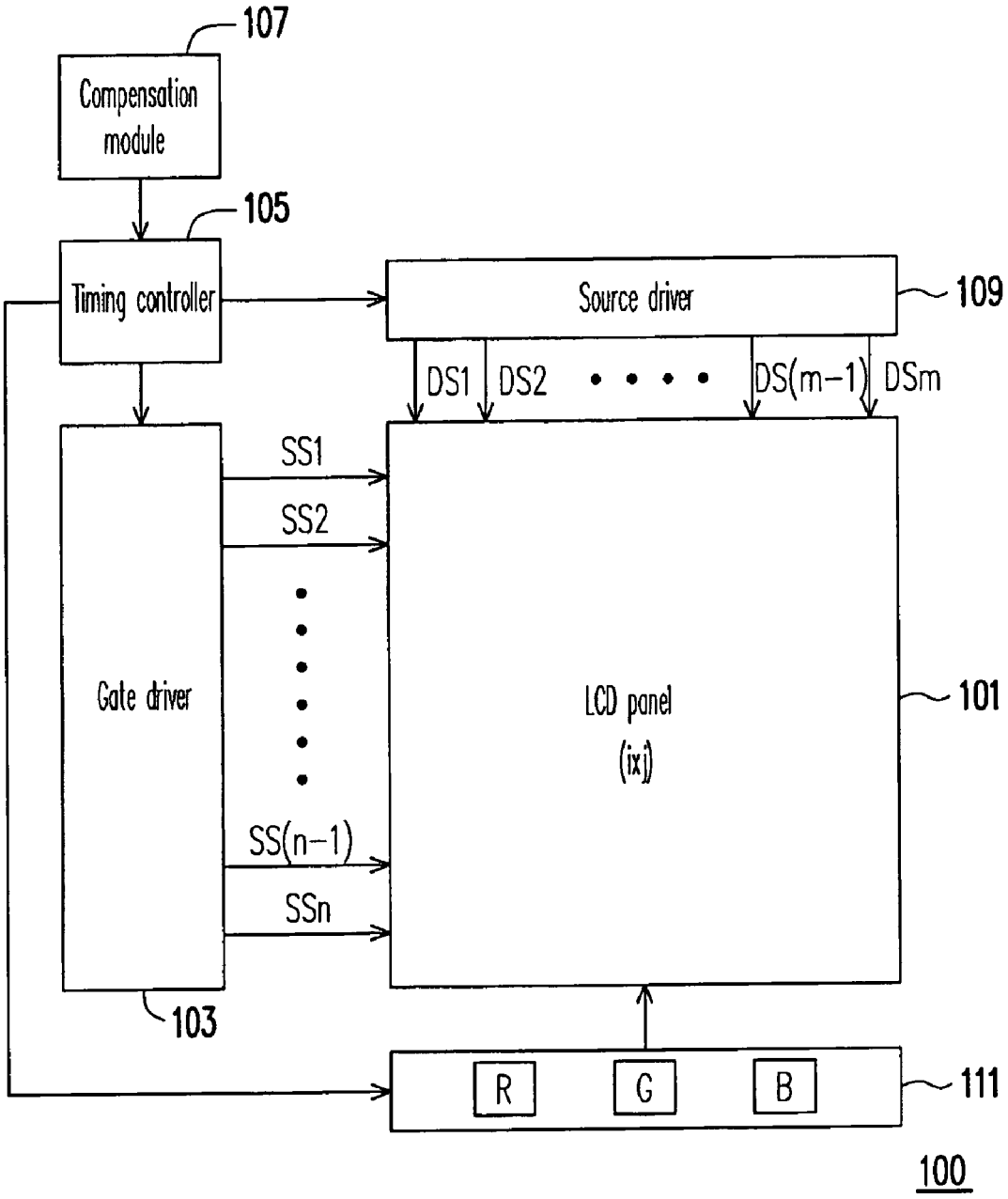
FIG. 1 is a block diagram illustrating a system of an LCD 100 according to an embodiment of the invention.

FIG. 1 is a block diagram illustrating a system of an LCD 100 according to an embodiment of the invention. Referring to FIG. 1, the LCD 100 includes an LCD panel 101, a gate driver 103, a timing controller (T-con) 105, a compensation module 107, a source driver 109, and a backlight module 111. The LCD panel 101 has a plurality of pixels arranged in an i×j matrix, and i and j are positive integers.

The backlight module 111 is coupled to the LCD panel 101 and is controlled by the T-con 105. The backlight module 111 is used to provide a planar light source required by the LCD panel 101, and the backlight module 111 can be an LED backlight module, for example. Therefore, the LCD 100 can be a color sequential LCD.

The gate driver 103 is coupled to the LCD panel 101 and is controlled by the T-con 105. The gate driver 103 of the present embodiment is used to sequentially output a plurality of scan signals SS1~SSn to the LCD panel 101, so as to turn on a plurality of row pixels of the LCD panel 101 one by one. Here, the number of n is equal to j, and an enabling time of the scan signals SS1~SSn is not constant. The source driver 109 coupled to the LCD panel 101 and controlled by the T-con 105 is used to provide data signals DS1~DSm to the row pixels turned on by the gate driver 103 in the LCD panel 101. Here, the number of m is equal to i.

In order to allow the gate driver 103 to sequentially output the plurality of scan signals SS1~SSn having the unfixed enabling time to the LCD panel 101, the compensation module 107 is coupled to the T-con 105 in the present embodiment and is used to determine a compensation time. The T-con 105 then adjusts the enabling time of the scan signals SS1~SSn excluding the last scan signal SSn according to the compensation time determined by the compensation module 107, so as to unfix the enabling time of each of the scan signals SS1~SSn output by the gate driver 103.

It should be mentioned that the adjusted enabling time of the $(i+1)^{th}$ scan signal is more than the adjusted enabling time of the $i^{th}$ scan signal, and i is a positive integer. For instance, the adjusted enabling time of the second scan signal SS2 is more than the adjusted enabling time of the first scan signal SS1, the adjusted enabling time of the third scan signal SS3 is more than the adjusted enabling time of the second scan signal SS2, and so on.

Nevertheless, the last scan signal SSn output by the gate driver 103 needs no adjustment, which will be elaborated later. Besides, the enabling time of the last scan signal SSn output by the gate driver 103 is more than the enabling time of the $(n-1)^{th}$ scan signal SS(n−1) as well. Note that there can be an unfixed time interval or no time interval between the adjusted enabling time of the $(i+1)^{th}$ scan signal and the adjusted enabling time of the $i^{th}$ scan signal.

Figure 2:
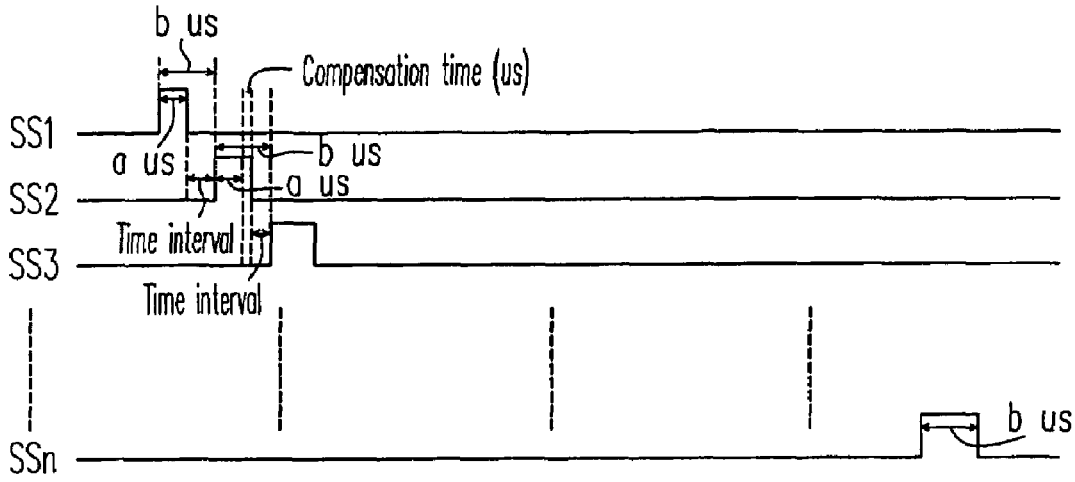
FIG. 2 is a schematic waveform of scan signals SS1~SSn output by a gate driver 103 according to an embodiment of the present invention.

For example, there can be an unfixed time interval between the adjusted enabling time of the second scan signal SS2 and the adjusted enabling time of the first scan signal SS1. That is to say, after the first row pixels of the LCD panel 101 are turned on by the scan signal SS1, the second row pixels of the LCD panel 101 are turned on by the scan signal SS2 after a lapse of the unfixed time interval, and the following row pixels of the LCD panel 101 will be turned on in a similar manner. For the purposes of promoting an understanding of the above, please refer to FIG. 2 which is a schematic waveform of the scan signals SS1~SSn.

Figure 3:
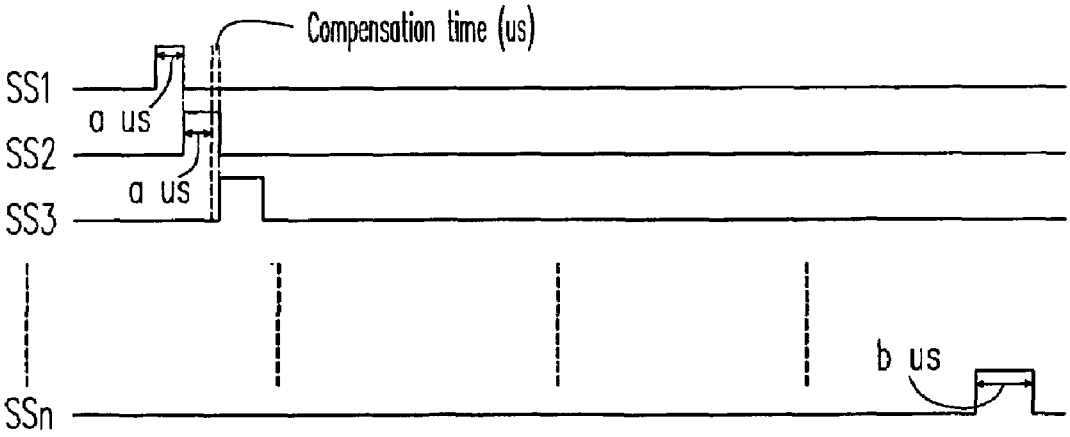
FIG. 3 is a schematic waveform of the scan signals SS1~SSn output by the gate driver 103 according to another embodiment of the present invention.

On the other hand, there can also be no internal between the adjusted enabling time of the second scan signal SS2 and the adjusted enabling time of the first scan signal SS1. Namely, the second row pixels of the LCD panel 101 are turned on by the scan signal SS2 right after the first row pixels of the LCD panel 101 are turned on by the scan signal SS1, and the following row pixels of the LCD panel 101 will be turned on in a similar manner. For the purposes of promoting an understanding of the above, please refer to FIG. 3 which is a schematic waveform of the scan signals SS1~SSn.

Based on the above, the compensation time determined by the compensation module 107 is a decisive factor in the present embodiment. In the present embodiment, the compensation time is determined by the compensation module 107 upon performing following steps. First, a reference scan signal is provided to the last row pixels of the LCD panel 101, and a data signal provided by the source driver 109 is transmitted to the last row pixels of the LCD panel 101 according to an enabling time of the reference scan signal, so as to obtain a reference transmittance of the last row pixels of the LCD panel 101.

Next, a test scan signal is provided to the first row pixels of the LCD panel 101, and the data signal is provided to the first row pixels of the LCD panel 101 according to an enabling time of the test scan signal, so as to obtain a test transmittance of the first row pixels of the LCD panel 101. Here, the enabling time of the test scan signal is less than the enabling time of the reference scan signal.

Thereafter, the test transmittance is compared with the reference transmittance. If the test transmittance is not equal to the reference transmittance, the enabling time of the test scan signal is adjusted, so as to substantially equalize the test transmittance with the reference transmittance. Finally, a subtraction is performed between the enabling time of the reference scan signal and the adjusted enabling time of the test scan signal, and the result of the subtraction is further divided by the number of all scan lines of the LCD panel 101, so as to obtain the compensation time. Here, the number of all the scan lines is the same as the number of j.

For instance, if the enabling time of the reference scan signal is b microseconds (us), the adjusted enabling time of the test scan signal is a microseconds (us), and the resolution of the LCD panel 101 is 1024×768, the compensation time is (b-a)/768 microseconds (us). As such, the enabling time of the $(n-1)^{th}$ scan signal SS(n−1) is (b-one compensation time) microseconds (us), the enabling time of the $(n-2)^{th}$ scan signal SS(n−2) is (b-two compensation times) microseconds (us), the enabling time of the $(n-3)^{th}$ scan signal SS(n−3) is (b-three compensation times) microseconds (us), and so forth. Thereby, it can be deduced that the enabling time of the first scan signal SS1 is (b-767 compensation time) microseconds (us), so as to obtain a microseconds (us) as assumed above.

In view of the foregoing, since the transmittance corresponding to the data voltage applied to the last row pixels of the LCD 101 serves as the reference transmittance according to the present embodiment, the last scan signal SSn output by the gate driver 103 is not required to be adjusted, while the other scan signals SS1~SS(n−1) must be adjusted. However, note that the LCD 100 is the color sequential LCD, and the refresh frequency of the LCD 100 is 5.56 microseconds (1/180 second). Thus, after the scan signal SS1 is received by the first row pixels of the LCD panel 101, the scan signal SSn must be received by the last row pixels of the LCD panel 101 within 5.56 microseconds. In the present embodiment, the time lapse between the receipt of the scan signal SS1 by the first row pixels of the LCD panel 101 and the receipt of the scan signal SSn by the last row pixels of the LCD panel 101 is at least 5 microseconds, whereas the actual time lapse is not limited in the present invention.

Additionally, the compensation time is progressively reduced by one at a time from the enabling time of the scan signals SS1~SSn that are output by the gate driver 103, starting from the enabling time of the last scan signal SSn to the enabling time of the first scan signal SS1. Namely, it can be known that the enabling time of the first scan signal SS1 is the shortest, while a response time of liquid crystal molecules in the corresponding row pixels is the longest. By contrast, notwithstanding the fact that the enabling time of the last scan signal SSn is the longest, the response time of the liquid crystal molecules in the corresponding row pixels is the shortest. In such manner, as the same data voltage is applied by the source driver 109 to each of the row pixels of the LCD panel 101, the luminance of each of the row pixels of the LCD panel 101 can substantially reach the same level. Thereby, the conventional issue of the uneven brightness of the color sequential LCD can be resolved.

Figure 4:
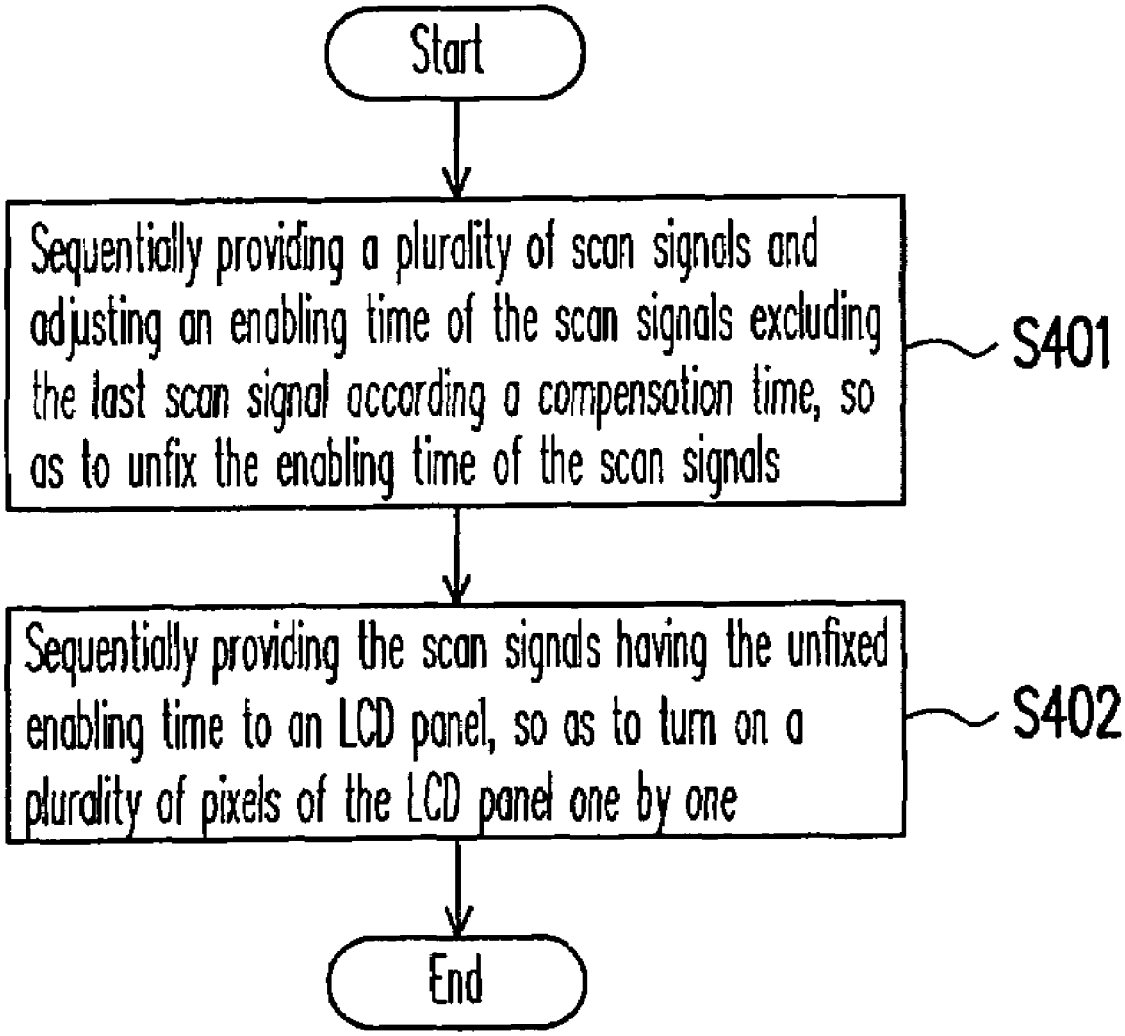
FIG. 4 is a flowchart illustrating a method for driving an LCD panel according to an embodiment of the present invention.

A method for driving an LCD panel is provided hereinafter according to the aforesaid embodiments so as to serve as a reference for those skilled in the pertinent art of the present invention. FIG. 4 is a flowchart illustrating a method for driving an LCD panel according to an embodiment of the present invention. Referring to FIG. 4, the method for driving the LCD panel includes following steps. Firstly, as provided in step S401, a plurality of scan signals are provided sequentially, and an enabling time of the scan signals excluding the last scan signal is adjusted according to a compensation time, so as to unfix the enabling time of these scan signals. Next, in step S402, the scan signals having the unfixed enabling time are sequentially provided to the LCD panel, so as to turn on a plurality of row pixels of the LCD panel one by one.

In the present embodiment, the compensation time is determined upon performing following steps. First, a reference scan signal is provided to the last row pixels of the LCD panel, and a data signal is provided to the last row pixels of the LCD panel according to an enabling time of the reference scan signal, so as to obtain a reference transmittance of the last row pixels of the LCD panel. Next, a test scan signal is provided to the first row pixels of the LCD panel, and the data signal is provided to the first row pixels of the LCD panel according to an enabling time of the test scan signal, so as to obtain a test transmittance of the first row pixels of the LCD panel. Here, the enabling time of the test scan signal is less than the enabling time of the reference scan signal.

Thereafter, the test transmittance is compared with the reference transmittance. If the test transmittance is not equal to the reference transmittance, the enabling time of the test scan signal is adjusted, so as to substantially equalize the test transmittance with the reference transmittance. Finally, a subtraction is performed between the enabling time of the reference scan signal and the adjusted enabling time of the test scan signal, and the result of the subtraction is further divided by the number of all scan lines of the LCD panel, so as to obtain the compensation time.

In addition to the above, according to the present embodiment, the adjusted enabling time of the $(i+1)^{th}$ scan signal is more than the adjusted enabling time of the $i^{th}$ scan signal, and i is a positive integer. Note that there can be an unfixed time interval or no time interval between the adjusted enabling time of the $(i+1)^{th}$ scan signal and the adjusted enabling time of the $i^{th}$ scan signal.

To sum up, in the method for driving the LCD panel as disclosed in the present invention, the scan signals having the unfixed enabling time are provided to the LCD panel. Besides, based on the transmittance corresponding to the data voltage applied to the last row pixels of the LCD panel, the compensation time is reduced by one at a time until the data voltage is applied to the first row pixels of the LCD panel. Namely, the enabling time of the scan signal provided to the last row pixels of the LCD panel is the longest, while the enabling time of the scan signal provided to the first row pixels of the LCD panel is the shortest. With use to the adjusted scan signals, the row pixels of the LCD panel are turned on one by one.

Thus, when the same data voltage is applied to each of the row pixels of the LCD panel, the brightness of each of the row pixels of the LCD panel substantially reaches the same level. As such, the LCD (e.g. the color sequential LCD) employing the method for driving the LCD panel as disclosed in the present invention can be characterized by the uniform display brightness.

Although the present invention has been disclosed by the above embodiments, they are not intended to limit the present invention. Anybody skilled in the art may make some modifications and alterations without departing from the spirit and scope of the present invention. Therefore, the protection range of the present invention falls in the appended claims.

What is claimed is:

1. A method for driving a liquid crystal display (LCD) panel, the method comprising:

sequentially providing a plurality of scan signals and adjusting an enabling time of the scan signals excluding the last scan signal according to a compensation time, so as to unfix the enabling time of the scan signals; and sequentially providing the scan signals having the unfixed enabling time to an LCD panel, so as to turn on a plurality of row pixels of the LCD panel, wherein the compensation time is determined by performing the following steps of:

providing a reference scan signal to the last row pixels of the LCD panel and providing a data signal to the last row pixels of the LCD panel according to an enabling time of the reference scan signal, so as to obtain a reference transmittance of the last row pixels of the LCD panel;

providing a test scan signal to the first row pixels of the LCD panel and providing the data signal to the first row pixels of the LCD panel according to an enabling time of the test scan signal, so as to obtain a test transmittance of the first row pixels of the LCD panel, wherein the enabling time of the test scan signal is less than the enabling time of the reference scan signal;

comparing the test transmittance with the reference transmittance and adjusting the enabling time of the test scan signal if the test transmittance is not equal to the reference transmittance, so as to substantially equalize the test transmittance with the reference transmittance; and performing a subtraction between the enabling time of the reference scan signal and the adjusted enabling time of the test scan signal and further dividing the result of the subtraction by the number of all scan lines of the LCD panel, so as to obtain the compensation time.

2. The method for driving the LCD panel as claimed in claim 1, wherein the adjusted enabling time of the $(i+1)^{th}$ scan signal is more than the adjusted enabling time of the $i^{th}$ scan signal, and i is a positive integer.

3. The method for driving the LCD panel as claimed in claim 2, wherein there exists an unfixed time interval between the adjusted enabling time of the $(i+1)^{th}$ scan signal and the adjusted enabling time of the scan signal.

4. The method for driving the LCD panel as claimed in claim 3, wherein there exists no time interval between the adjusted enabling time of the $(i+1)^{th}$ scan signal and the adjusted enabling time of the $i^{th}$ scan signal.

5. A liquid crystal display (LCD), comprising:

an LCD panel having a plurality of pixels arranged in matrix;

a gate driver coupled to the LCD panel and controlled by a timing controller, the gate driver being used to sequentially output a plurality of scan signals having an unfixed enabling time to the LCD panel, so as to turn on the plurality of row pixels of the LCD panel one by one; and a compensation module coupled to the timing controller and used to determine a compensation time, wherein the timing controller adjusts the enabling time of the scan signals excluding the last scan signal according to the compensation time, so as to unfix the enabling time of the scan signals, wherein the compensation time is determined by performing following steps of:

providing a reference scan signal to the last row pixels of the LCD panel and providing a data signal to the last row pixels of the LCD panel according to an enabling time of the reference scan signal, so as to obtain a reference transmittance of the last row pixels of the LCD panel;

providing a test scan signal to the first row pixels of the LCD panel and providing the data signal to the first row pixels of the LCD panel according to an enabling time of the test scan signal, so as to obtain a test transmittance of the first row pixels of the LCD panel, wherein the enabling time of the test scan signal is less than the enabling time of the reference scan signal;

comparing the test transmittance with the reference transmittance and adjusting the enabling time of the test scan signal if the test transmittance is not equal to the reference transmittance, so as to substantially equalize the test transmittance with the reference transmittance; and performing a subtraction between the enabling time of the reference scan signal and the adjusted enabling time of the test scan signal and further dividing the result of the subtraction by the number of all scan lines of the LCD panel, so as to obtain the compensation time.

6. The LCD as claimed in claim 5, further comprising a source driver coupled to the LCD panel.

7. The LCD as claimed in claim 5, further comprising a backlight module coupled to the LCD panel.

8. The LCD as claimed in claim 7, wherein the backlight module is a light emitting diode (LED) backlight module.

9. The LCD as claimed in claim 5, wherein the adjusted enabling time of the $(i+1)^{th}$ scan signal is more than the adjusted enabling time of the scan signal, and i is a positive integer.

10. The LCD as claimed in claim 9, wherein there exists an unfixed time interval between the adjusted enabling time of the $(i+1)^{th}$ scan signal and the adjusted enabling time of the $i^{th}$ scan signal.

11. The LCD as claimed in claim 9, wherein there exists no time interval between the adjusted enabling time of the $(i+1)^{th}$ scan signal and the adjusted enabling time of the $i^{th}$ scan signal.

* * * * *